US005875911A

United States Patent [19]

McEldowney

[11] Patent Number: 5,875,911

[45] Date of Patent: Mar. 2, 1999

[54] EASY OPEN CONTAINER END WITH METHOD OF MANUFACTURE, AND TOOLING

[75] Inventor: Carl McEldowney, Sidney, Ohio

[73] Assignee: Aluminum Company of America, Pittsburgh, Pa.

[21] Appl. No.: 803,853

[22] Filed: Feb. 28, 1997

[51] Int. Cl.[6] ..... B65D 17/34

[52] U.S. Cl. ..... 220/269; 220/906

[58] Field of Search ..... 220/269, 270, 220/906

[56] References Cited

U.S. PATENT DOCUMENTS

D. 275,373 9/1984 Brown et al. .
D. 337,521 7/1993 McNulty .
D. 364,807 12/1995 Taylor .
D. 365,988 1/1996 Clark, III .
4,015,744 4/1977 Brown .
4,024,981 5/1977 Brown ..... 220/269
4,030,631 6/1977 Brown .
4,148,410 4/1979 Brown .
4,266,688 5/1981 Reid ..... 220/273
4,363,419 12/1982 Walz, Sr. ..... 220/269
4,433,792 2/1984 Mandel ..... 220/269
4,465,204 8/1984 Kaminski et al. .
4,503,989 3/1985 Brown et al. .
4,530,631 7/1985 Kaminski et al. .
4,610,156 9/1986 Kaminski et al. .
4,930,658 6/1990 McEldowney .
5,129,541 7/1992 Voight et al. ..... 220/269
5,715,964 2/1998 Turner et al. ..... 220/269

*Primary Examiner*—Stephen K. Cronin
*Attorney, Agent, or Firm*—Thomas R. Trempus

[57] ABSTRACT

An easy open can end having shallow panel integrally formed in the tear away panel and a tab nose bead formed on the panel proximate the rivet, a method of further forming a can end to incorporate the aforedescribed features, and tooling for the further forming of the easy opening end.

14 Claims, 4 Drawing Sheets

EASY OPEN CONTAINER END WITH METHOD OF MANUFACTURE, AND TOOLING

BACKGROUND OF THE INVENTION

1. Field of the Invention

The present invention relates to easy-open ends for product containers, particularly, beverage and beer cans. In particular, the present invention provides an improved method for forming easy-open ends, improved tooling, and an improved can end that demonstrates superior functionality, particularly in its opening characteristics.

2. Prior Art

Many metallic cans for holding beverages or other products are provided with easy-open can ends, wherein a pull tab attached to a tear strip that is defined by a score in the can end. The pull tab may be lifted and then pulled to provide an opening in the can end for dispensing the can's contents. For ecological and safety reasons, many regions require that the tear strip and attached pull tab be retained to the can end after opening. In order to meet these requirements, various designs have been suggested by the prior art for ensuring that the tear strip and pull tab do not become separated from the can end. Generally, the pull tab is retained on the can end by means of a rivet. Methods of forming a can end can be found in U.S. Pat. Nos. 4,465,204 and 4,530,631 both to Kaminski et al., and assigned to the assignee of the instant invention. These patents are incorporated by reference as if fully set forth herein.

In the manufacture of an easy-open can end, a can end shell is first formed from a metal sheet product, preferably an aluminum sheet product. The can end shell is then transferred to a conversion press. In the typical operation of a conversion press, a can end shell is introduced between an upper tool member and a lower tool member which are in the open, spaced apart position. A press ram advances the upper tool member toward the lower tool member in order to perform any of a variety of metal forming operations such as rivet forming, paneling, scoring, embossing, tab securing, and final staking. After performing an operation, the press ram retracts until the upper tool member and lower tool member are once again in the open, spaced apart position. The partially converted shell is transported to the next successive tooling operation until an easy-open can end is completely formed and discharged from the press. As one shell leaves a given tooling operation, another shell is introduced to the vacated operation, thus continuously repeating the entire easy-open can end manufacturing process.

In certain canned products, such as carbonated beverages, there is substantial internal pressure that can be in the order of 90 to 100 psi or even greater, and must be quickly and safely vented during the initial opening of the can end by the consumer. According, can ends are constructed for venting or releasing the internal pressure of the container during the initial operation of the easy open mechanism of the end. The mechanism of venting is described in prior art patents such as U.S. Pat. Nos. 4,015,744 and 4,030,631, the contents of which are incorporated by reference herein as if fully set forth. As briefly mentioned above, the easy open mechanism includes an end panel which is attached to the can body or container. A tear panel is defined in the end panel by a scoreline. An operating tab including a nose which extends partially over the tear panel is connected by a rivet to the end panel. The rivet defines a pivot point for tab operation. My co-pending patent application U.S. Ser. No. 08/476,406, filed Jun. 7, 1996, entitled, "Improved Easy Open Container End, Method of Manufacture, and Tooling" discloses new features that cooperates with the scoreline.

Basically, initial lifting of the tab produces an upward force on the rivet and a downward force on the edge of the tear panel adjacent a beginning point of the tear panel scoreline. This in turn causes an initial opening of the tear panel beneath the nose of the tab in an area referred to as the vent region of the can end. Further lifting motion of the tab causes the tear panel to separate progressively along its scoreline, leaving a small integral connection or hinge between the end panel and the tear panel, about which the tear panel is rotated. The separation of the tear panel defines an opening through which container's contents can be poured.

As mentioned above, there can be substantial internal gas pressure in the container. During the initial opening motion, this gas pressure must vent safely. It is the typical practice to define a small vent opening with a hook formation at the radially inward end of the scoreline. The vent opening or region extends to a score stop located in the region where the tear panel scoreline proceeds outward at the end. Typically, the score stop is in the form of a shallower segment of the scoreline of relatively short length as described in U.S. Pat. No. 4,503,989. The contents of this patent are incorporated herein by reference as if fully set forth. This score stop provides an increase in tear resistance along the scoreline. This opening process can be identified by the initial "pop" that is heard when the tab is lifted, followed by the "metal tearing" sound that accompanies the separation of the tear panel from the can end as the nose of the tab is "pushed" against the tear panel.

The continuing evolution toward larger tear away panel opening areas relative to the overall surface area of the can end has created several challenges in the can making industry. This relative size of the tear away panel is at least in part the result of the continuous down-sizing of can end diameters.

It is useful to understand what is meant by reference to a "large" opening end or to "larger" tear away panels. For example, a conventional 202 easy open end has a tear away panel that defines an area of approximately 0.450 square inches. The same 202 easy open end that is equipped with a larger tear away panel has a panel that defines an area of approximately 0.596 square inches. Accordingly, a large opening end may be characterized as being between about 20% and 40% larger than a conventional tear panel. Among the challenges associated with larger tear away panels are: the prevention of missiling or tear panel blow off, i.e., the catastrophic failure of the tear panel; the efficient mechanical operation of the larger tear panel with the use of the existing tab; the avoidance of the partial opening or incomplete opening of the tear panel; and maintaining "pop" and "push" values at a level that is satisfactory and convenient to the end user. Examples of large opening ends are available in my co pending patent applications, including application Ser. No. 29/048,638.

The instant invention also addresses a technique for providing heightened control of the panel opening process through the use of a tab nose bead formed into the tear away panel.

It is an object of this invention to provide a can end having a large opening tear panel that demonstrates improved and consistently-acceptable operational capabilities.

It is yet another object of this invention to provide a can end tear away panel configuration suitable for use with both conventional and large opening ends.

It is still another object of this invention to provide an improved set of tooling for the manufacture of converted can ends.

It is another object of this invention to provide a converted can end and a method for manufacturing the same.

SUMMARY OF THE INVENTION

The invention provides an easy open can end with unique features formed into the tear away panel structure structure such that openability is enhanced for conventional and large opening ends. Additionally, the improved panel structure includes a tab nose bead disposed on the tear away panel. The invention further provides both a method for further forming a can end to incorporate the unique individual-structural features described above, and tooling for carrying out the process and apparatus of the invention. In an easy open can end for a beer or beverage container the can end has a tear panel defined by a fracture scoreline surrounding a portion of the periphery of said tear panel. The fracture scoreline defines a region where the tear panel is to be separated from the remainder of the end to define an opening through the end. The end includes an operating tab and an integral rivet attaching the tab to the end adjacent the fracture scoreline. The rivet is on the opposite side of the fracture scoreline from the tear panel. The fracture scoreline includes a vent region adjacent the rivet constructed and arranged to open initially at the vent region in response to the lifting of the rivet by the tab. During the lifting of the tab there is often an initial "pop" followed by some brief resistance. Once this resistance, typically an anti-missiling feature, is overcome, the tear panel tends to separate from the panel with a generally uniform pressure. This final opening effort is often referred to in the industry as the "push" that follows the initial "pop" that occurs when the consumer opens an easy open can end and vents its contents.

According to my invention, the tear away panel is further formed to include a tab nose bead and a deformation in the tear away panel that defines a shallow panel.

Tooling for the conversion of a can end shell into an easy open can end comprises several separate stations that are adapted for incorporation into a complete tooling set for a can end conversion press. According to this invention, preferably one of the tooling stations is adapted to further form the panel metal so as to provide the shallow panel and optionally, the nose bead.

DESCRIPTION OF THE DRAWINGS

The above as well as other features and advantages of the present invention can be appreciated through consideration of detailed description of the invention in conjunction with the several drawings in which.

DETAILED DESCRIPTION OF THE PREFERRED EMBODIMENT

Figure 1A:
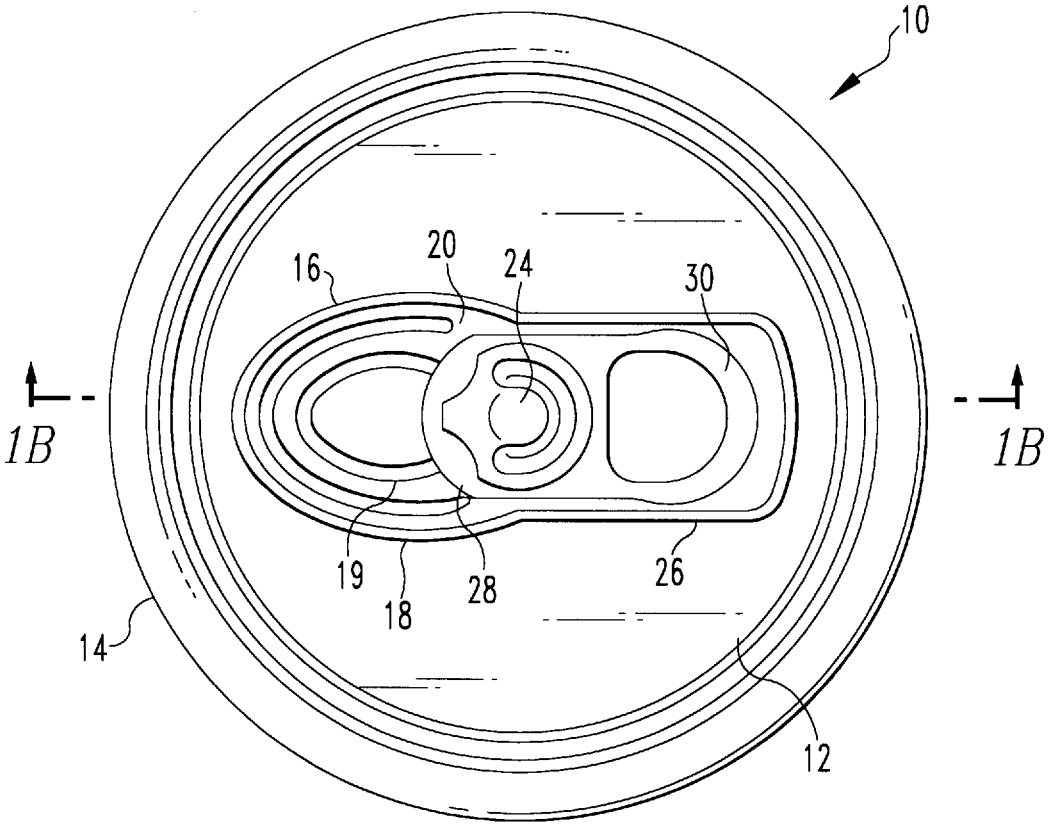
FIG.1A (PRIOR ART)
FIG. 1A is a top plan view of a conventional prior art easy-open can end.
Figure 1B:
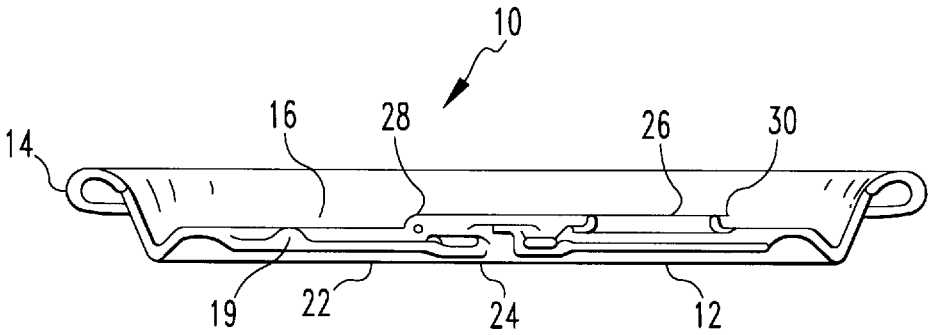
FIG.1B (PRIOR ART)
FIG. 1B is a cross sectional side view along lines 1B—1B of FIG. 1A.

A conventional converted can end incorporating that is well known in the art is shown in FIGS. 1A and 1B, that are identified as being Prior Art. Can end 10 has an end panel 12 of generally circular shape which includes a circumferentially extending raised edge 14 for attaching the can end 10 to a suitable cylindrical beverage can (not shown) or the like. In general, the can end 10 will be manufactured of a relatively ductile metal such as aluminum, but it may be made from other acceptable materials as required.

A retained tear strip 16 extends across can end 10 from a position spaced inwardly of raised edge 14 to approximately the center of can end 10. Tear strip 16 is defined by a generally V-shaped score 18 with open end 20 of the V positioned toward the center of can end 10. A score 18 is interrupted so that tear strip 16 will be captively retained on the underside or product side, 22 of can end 10 when torn open. The tear strip, or retained panel, 16 is typically re-enforced by means of a bead 19 that is formed into the panel 16. It is the conventional practice to form the bead 19 so that it follows the contour of the score 18. The bead 19 may or may not continue under the nose of the pull tab 26. Nevertheless, the bead 19 typically is continuous and serves to stiffen the panel.

An integral rivet 24 is positioned adjacent open end 20 of V-shaped score 18, and a graspable ring-like pull tab 26 which may be of any desired size and configuration is secured to can end 10 by means of rivet 24. Pull tab 26 is provided with a nose portion 28 to initiate the tear along score 18 upon lifting of pull tab 26 whereupon tear strip 16 is torn open as is well known in the art. As can be seen, pull tab 26 is provided with a finger portion 30 opposite the nose portion 28. The open end 20 of the V-shaped score is below the nose 28 of the tab 26 and the adjacent the rivet 24. This portion of the can end 10 panel 12 is the vent region. It is during the initial lifting of the tab by the consumer, that this vent region is opened and internal pressure released or vented. It is to be appreciated that the industry is constantly striving to reduce the gauge of material from which can ends are manufactured. For example, most existing ends are dimensioned as 206, 204, or 202 diameter ends. A "206 diameter" end means that the end is 2 6/16 inches in diameter and a "202 diameter" end means that the end is 2 2/16 inches in diameter. As the can end has become smaller and smaller in diameter, so also has the gauge of the metal used to fabricate the end been reduced. The 206 diameter end was typically manufactured from metal having a thickness of between about 0.0096 and 0.0106 inches, while a 202 diameter end is typically manufactured from metal having a thickness of about 0.0088 inch. As mentioned above, as the diameter of the end has decreased, the relative size of the tear away panel has increased, even before the dimensions of the panel opening were enlarged.

Figure 2:
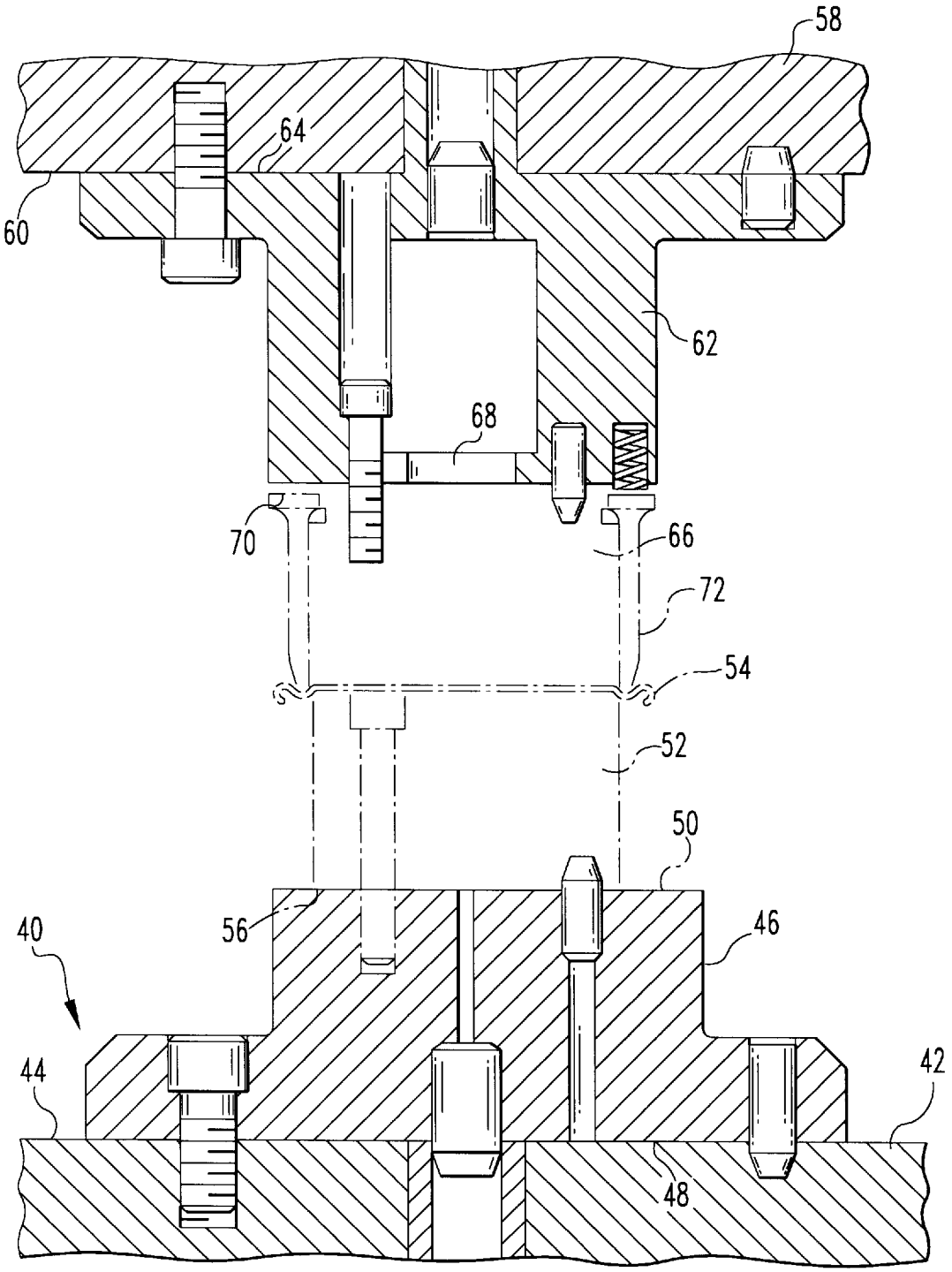
FIG. 2 is a cross sectional side view illustrating the press ram tool support means, ram, upper and lower tool members, a support base and a stationary press bed.

The manufacture of a can end shell into an easy-open can end takes place in a conversion press, a portion of which is shown in FIG. 2. The Minster Machine Company of Minster, Ohio manufactures and sells an industrial press suitable for configuration as a can end conversion press. The conversion press 40 generally include a stationary press bed 42 including a generally planar horizontal upper surface 44. The upper surface supports a tooling base 46 which has a planar bottom surface 48 and a planar upper surface 50. Positioned upon the upper surface of tooling base is a lower tooling member 52 (shown in phantom) which make take a variety of shapes depending upon the tooling operation to be performed on the can end shell 54. However, each lower tooling member 52 has a planar bottom surface 56 which mates with the upper surface 50 of the tooling base 46 to provide secure support for the lower tooling member 52.

A vertically displaceable press ram 58 overlies press bed and includes a generally planar horizontal lower surface 60. This surface 60 of the press ram 58 supports a tool support means 62 which may take a plurality of shapes depending upon the type selected for a particular tooling operation. In general, however, the tooling support means or base 62 includes an upper planar surface 64 which provides solid mating contact with the surface 60 of the press ram 58 so that the tooling support means 62 is securely fastened to the press ram. The tool support means 62 securely supports an upper tooling member (shown in phantom) 66 having an upper planar surface 68 that is in mating contact with the lower planar surface 70 of the tool support means 62. The upper tooling member 66 can be one of many shapes and sizes depending upon the particular tooling operation to be performed. Typically, a centering ring 72 locates the can end shell 54 in each tooling station. The various types of tooling operations to be performed in succession include: bubble forming in the center of the open can lid, forming the bubble into a button; scoring an opening; paneling the can end in an area surrounding the scored opening; staking the pull tab to the can end; and stamping incise lettering upon the can end for messages such as "lift up, pull back" or "dispose of properly". U.S. Pat. No. 4,610,156, which is assigned to the assignee of the instant invention, sets forth a detailed description of the various tooling stations of a conversion press. The contents of this patent are incorporated herein by reference as if fully set forth. The can end conversion process may require from six to eight stations in which differently configured tooling carries out successive cold-working of the metal in the several steps in the conversion of a can end shell in an easy-open can end.

As shown in FIGS. 1*a* and 1*b*, the conventional, prior art practice is to form a stiffening bead 19 located inside of the score lines. This bead is typically called the "D-bead" and serves to stiffen the tear away panel to facilitate the separation of the tear away portion of the panel from the can end. In operation, the tab is rotated upwardly causing the score vent region proximate the tab rivet to separate. The separation initiates at the vent region and follows along in a clockwise manner along the score line, with the separation terminating in the hinge portion. At the hinge portion, the tear away panel bends downwardly from the product side of the can end panel. While the use of the stiffening bead has proven to be a desirable feature of standard size tear away panel openings, I have found that a stiffening bead when used in a larger opening can end may result in the failure of the tear panel to completely separate. I believe that this difficulty is due to the fact that the bead 19 disposed inside of the score path causes the disk to form a convex shape. As a result, when the tab is rotated upwardly to initiate separation along the score line, the bead tends to urge the tear away panel or disk in a generally outward direction against the score. This causes a phenomena that is known in the can end industry as a "lock-out". It is believed that this takes place because the tear panel tends to wedge itself into the opening defined by the score line.

Figure 3:
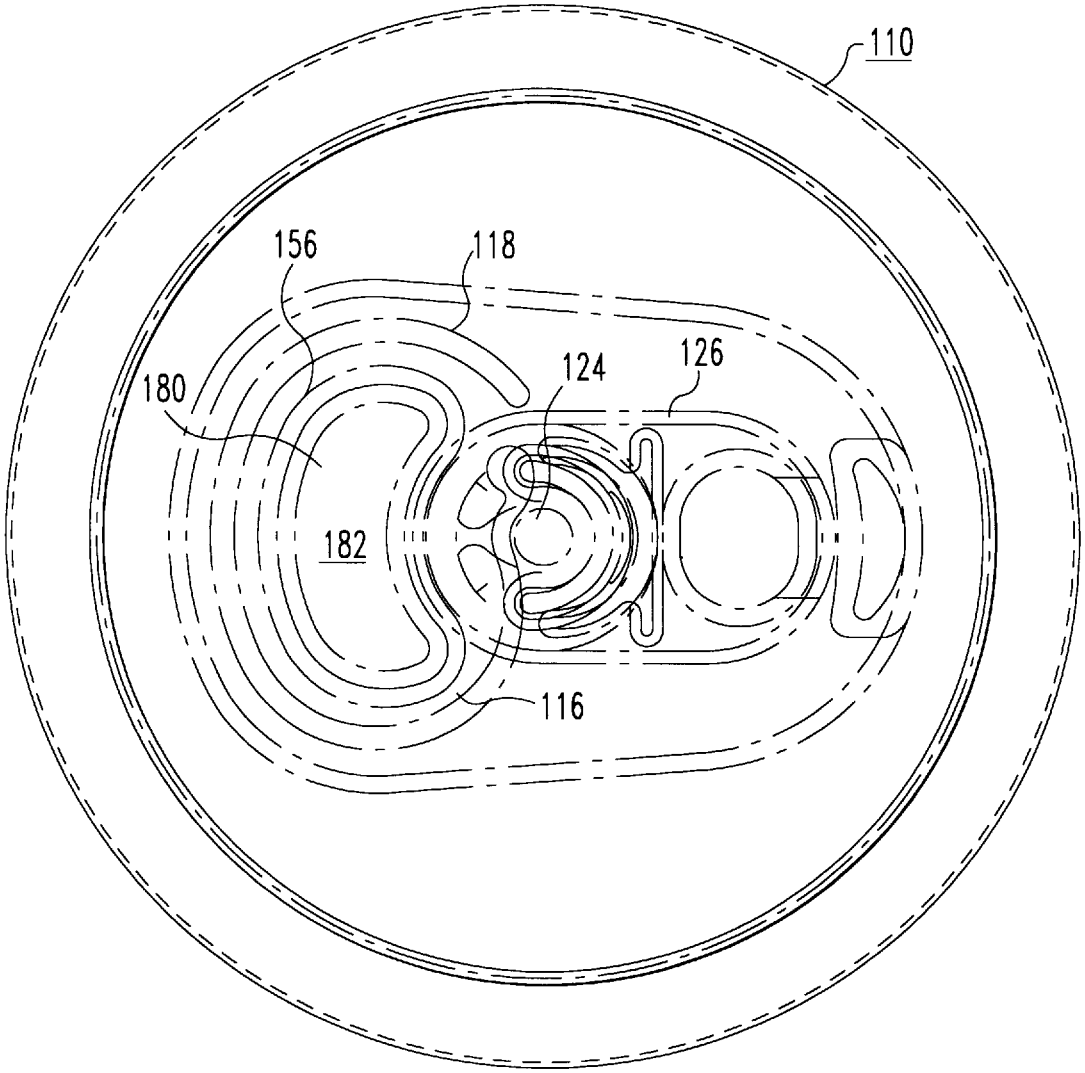
FIG. 3 is a top plan view with a tab illustrated in phantom showing the improved easy open can end tear panel incorporating a shallow panel and nose bead, all according to this invention.
Figure 4:
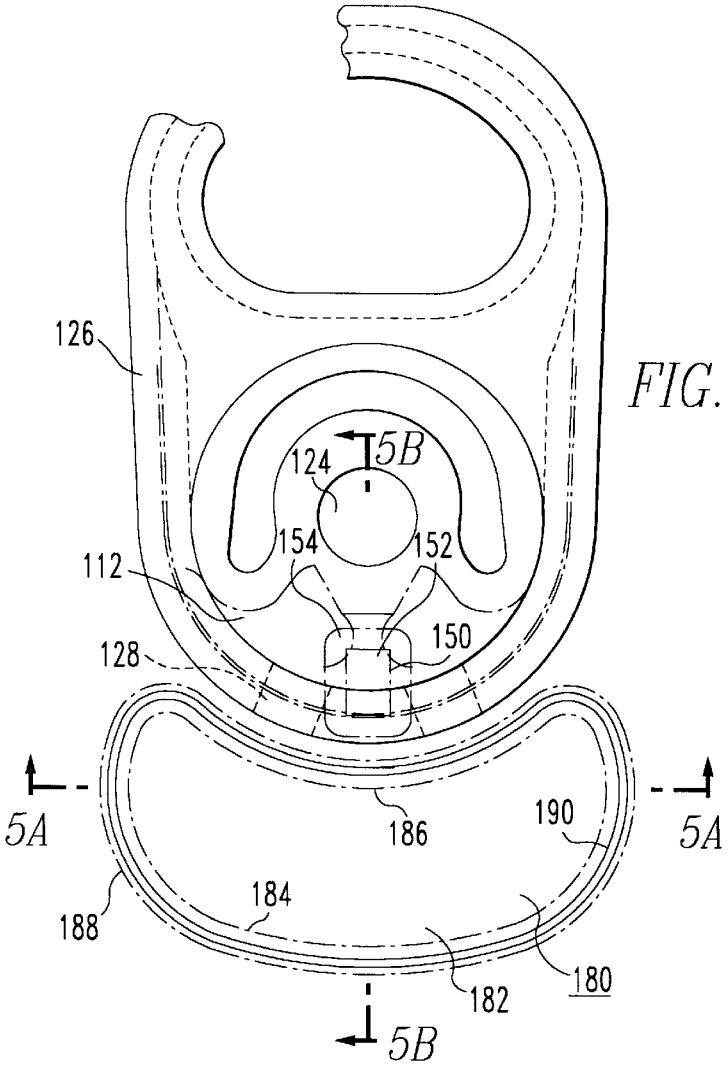
FIG. 4 is a partial detailed illustration with a tab in phantom of a can end showing the shallow panel and tab nose bead in detail.

Turning now to FIGS. 3 through 5, a can end incorporating the features of the instant invention is generally indicated by the reference character 110. A main score 118 defines the outline of the tear panel 116. As is known in the art, the depth of the scoreline 118 may vary along the perimeter of the tear panel 116 and include anti-missile features as previously discussed.

In order to resolve the problem described above, the instant invention further forms the tear panel 116 to include a shallow panel 182. This shallow panel is believed to allow the disk to stay flat or even to flex downwardly during the opening operation. As a result, as the tab is rotated upwardly to initiate venting and opening, the tear away panel flexes downwardly near its central region to effect the phenomenon wherein the tear away panel has a seemingly lesser diameter than the opening in which it had previously resided, thus facilitating the complete separation of the tear away panel from the can end. It is believed that the shallow panel configuration enhances the stiffness of the tear away panel proximate the rivet while at the same time facilitating the flexibility of the panel in the area of the panel distal the rivet. Thus the combination of relative stiffness on the one hand, and flexibility on the other, enhances the operation and thus the functionality of this member. It is also believed that the use of the shallow panel of this invention will permit the manufacture of a can end in which a higher score residual is maintained. To the consumer, the functionality of the easy-opening end is improved and access to the container's contents made easier and more reliable. I have also discovered that the use of a tab nose bead as at 150 may also serve to enhance even further the functionality of the end. It is to be understood that while the shallow panel and nose bead can both be incorporated into a can end, either feature may be used individually. In my preferred embodiment, the shallow panel is used alone.

The shallow panel 180 is formed in the panel 116 of the can end 112. The shallow panel is disposed downwardly with respect to the plain 156 defined by the tear panel. The shallow panel includes a forward portion 184 and a rearward portion 186 that is closest to the rivet 124 of the can end. Additionally, side portions 188 and 190 define the outward boundaries of the shallow panel. Preferably, the shallow panel slopes downwardly and rearwardly from a point as at 184 distal the rivet to 186 proximate the rivet. The rearward portion 186 of the shallow panel 180 is proximate and follows the profile of the tab nose 128. In other words, the rearward portion of the shallow panel may be curvilinear as shown to provide clearance for the location of the nose bead and surface area of the tear away panel with which the tab engages during opening. However, the nose 128 does not extend over the rear portion 128 of the shallow panel 180. The tear away panel 116 has a product surface 158 and a public surface 160. The shallow panel gradually slopes downwardly from a point at 184 defining the forward portion of the shallow panel increasing the relative distance of the bottom of the shallow panel's rearward portion 186 to a maximum depth with respect to the plane 156 at a point proximate the nose 128 of the tab 126. In practice, I have found it appropriate to form the shallow panel into the can end prior to the indexing of a can end into a tear away panel scoring station.

As best shown in FIGS. 3 and 4, a rivet 124 secures the tab 126 to the can end 112. A tab nose bead 150 is disposed beneath the nose portion 128 of the tab 126. The tab nose bead 150 is positioned between the rivet 124 and the shallow panel 180. The nose bead 150 consists of an elevated portion 152 and descending side walls 154.

The elevated portion 152 is higher than a first elevation defined by the bottom of the panel 112.

The metal from which the can end is formed has a thickness of about 0.085 to 0.088 inches. However, it is to be appreciated that the industry is constantly striving to reduce the thickness or gauge of the metal from which packaging is produced in order to enhance the savings achievable from the use of recyclable aluminum. Preferably, the tab nose bead is elevated above the plane defined by the tear away panel by approximately 0.010 inches to about 0.019 inches. It is preferred that the nose bead elevation be within the range of approximately 0.010 to 0.015 in order to minimize potential adverse effects on the stacking of the converted can ends. When seen in plan view, the tab nose bead 150 has a width of approximately 0.090 inches, plus or minus 0.005 inches and a longitudinal length with respect to the longitudinal axis of the tab 126 of about 0.125 inches plus or minus 0.005 inches. The tab nose bead provides a mechanism whereby the tab 126 can exert better push force upon the tear away panel 116 during the rotation of the tab about the rivet.

Figure 5B:
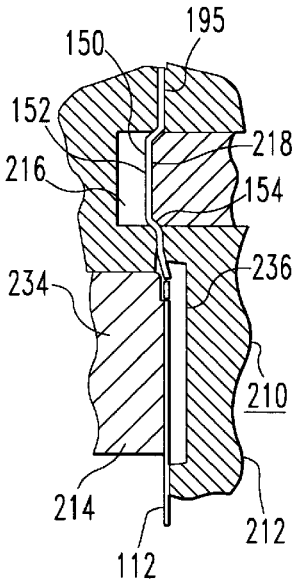
FIGS. 5A and 5B are enlarged sectional views of the upper and lower tooling along lines A—A and B—B respectively of FIG. 4 illustrating the further forming of the can end to incorporate the features of this invention as shown in FIG. 3.
Figure 5A:
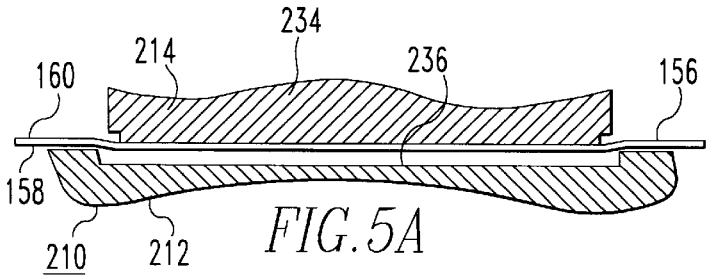

The tooling by which both the tab nose bead and the shallow panel can be formed into a can end is shown in sectional views in FIGS. 5A and 5B. The tooling 210 consists of a lower tooling member 212 and an upper tooling member 214. The upper tooling member 214 includes a relief portion 216 that corresponds with an anvil-like portion 218 disposed in the lower tooling member 212. The anvil 218 is preferably formed from a removable insert that allows for both replacement due to wear or adjustment through selective elevation thereof as is well known in the art.

Preferably, during operation, the tab nose bead is formed so as to have gently sloping side walls 154 extending from the elevated portion 152 to the panel. Appropriate clearance is provided between the top and sides of the anvil 218 and the relief portion 216 of tooling member 214.

The tooling by which the shallow panel is formed includes a lower portion 212 and an upper portion 214. The lower portion 212 includes a relief portion 236 into which the upper forming tooling portion 234 further forms the can panel when the tooling is moved from a spaced-apart position to a closed metal forming position. As can be seen, the longitudinal axis of the upper tooling member shows that the upper tooling member has an increasing depth from the forward portion of the shallow panel to the rearward portion proximate the rivet of the can end.

The instant invention is directed particularly to an improved method of can end formation, the tooling for this formation, and an easy-open can with improved openability resulting from the use of either a shallow panel, a tab nose bead disposed in the panel, or both. It is to be appreciated that while the improvements disclosed herein have been shown with a large opening end, either or both of these features are suitable for use with can ends incorporating a more traditionally sized tear away opening. While the method herein described, and the forms of apparatus for carrying this method into effect, constitute preferred embodiments of this invention, it is to be understood that the invention is not limited to this precise method and forms of apparatus, and that changes may be made in either without departing from the scope of the invention which is defined in the appended claims.

What is claimed is:

1. An easy-open end for a container comprising an end panel with a retained tear panel defined by a fracture score surrounding a portion of the periphery of said tear panel, said fracture score defining a region where said tear panel is to be separated from the remainder of the end to form an opening through said end, an operating tab, an integral rivet attaching said tab to said end adjacent said fracture score on the opposite side of said fracture score from said tear panel, and a shallow panel formed in said tear panel, said shallow panel including a forward portion and a rearward portion, which is closer to the rivet than the forward portion, and sloping downwardly and rearwardly from the forward portion to the rearward portion, whereby said shallow panel depends at least in part below said tear panel.

2. The easy open end according to claim 1 wherein the downwardly depending shallow panel forward portion terminates in the tear panel.

3. The easy open end according to claim 1 wherein the shallow panel has a maximum depth proximate the rivet.

4. An easy-open end for a container having an end panel in which a tear panel is defined by a fracture score surrounding a portion of the periphery of said tear panel and including a rivet proximate the tear panel, further formed to comprise a shallow panel formed into said tear panel, said shallow panel having a forward portion and a rearward portion, which is closer to the rivet than the forward portion, and whereas the shallow panel slope downwardly and rearwardly from the forward portion to the rearward portion.

5. The easy open end according to claim 4 wherein the end panel includes a rivet thereon proximate the tear panel and the tear panel's shallow panel has a maximum depth proximate the rivet.

6. The easy open end according to claim 4 wherein the shallow panel depends downwardly from the tear panel.

7. The easy open end according to claim 6 wherein the downwardly depending shallow panel forward portion terminates in the tear panel.

8. In an easy-open end for a container, said end having a tear panel defined by a fracture score surrounding a portion of the periphery of said tear panel, said fracture score defining a region where said tear panel is to be separated from the remainder of the end to form an opening through said end, an operating tab having a longitudinal axis extending from a nose portion extending partially over said tear panel to a finger lift portion opposite thereto, and an integral rivet attaching said tab to said end adjacent said fracture score on the opposite side of said fracture score from said tear panel, said fracture score including a vent region adjacent,said rivet constructed and arranged to open initially at said vent region in response to lifting of said rivet by said tab; the improvement comprising: a shallow panel formed in said tear panel, said tear panel defining a first elevation with respect to said end, and said shallow panel depending below said first elevation, said shallow panel including a forward portion and a rearward portion, which is closer to the rivet than the forward portion, and sloping downwardly and rearwardly from the forward portion to the rearward portion, wherein said shallow panel allows the tear panel to flex downwardly during opening operations.

9. The easy open end according to claim 8 wherein the downwardly depending shallow panel forward portion terminates in the tear panel.

10. The easy open end according to claim 8 wherein the tear panel's shallow panel has a maximum depth proximate the rivet.

11. The easy open end according to claim 8 further comprising a tab nose bead formed in the tear panel proximate the integral rivet and disposed below the nose portion of the tab which nose portion extends partially over the tear panel, said tab nose bead defining an elevated region in said tear panel adapted to be engaged by the tab nose portion during operation of the tab.

12. An easy open end as defined in claim 11, wherein the tab nose bead is disposed below the tab nose portion, along the longitudinal axis of the tab.

13. An easy open end as defined in claim 11, wherein the tab has a first predetermined width and the tab nose bead is of a second predetermined width that is between about ¼ to ¾ said first predetermined width.

14. An easy open end as defined in claim 11 wherein the tab nose bead is disposed below the tab nose so as to be in contact therewith during substantially all of the opening operation of tear panel.

* * * * *

UNITED STATES PATENT AND TRADEMARK OFFICE

CERTIFICATE OF CORRECTION

PATENT NO. : 5,875,911

DATED : March 2, 1999

INVENTOR(S) : Carl McEldowney

It is certified that error appears in the above-identified patent and that said Letters Patent is hereby corrected as shown below:

Col. 8, line 24, claim 4 After panel, delete "slope" and insert –slopes--.

Signed and Sealed this

Third Day of August, 1999

*Attest:*

Q. TODD DICKINSON

*Attesting Officer*

*Acting Commissioner of Patents and Trademarks*